US007201619B1

(12) United States Patent
Viggiano et al.

(10) Patent No.: US 7,201,619 B1
(45) Date of Patent: Apr. 10, 2007

(54) SAFETY SHUT-OFF SYSTEM FOR A POWERED VEHICLE

(75) Inventors: Anthony G. Viggiano, Groton, CT (US); Martin J. Loschiavo, Rocky Hill, CT (US)

(73) Assignee: Autotether, Inc., Rocky Hill, CT (US)

( * ) Notice: Subject to any disclaimer, the term of this patent is extended or adjusted under 35 U.S.C. 154(b) by 0 days.

(21) Appl. No.: 11/290,727

(22) Filed: Nov. 30, 2005

(51) Int. Cl.
*B63H 21/22* (2006.01)

(52) U.S. Cl. ..... 440/1; 440/84

(58) Field of Classification Search ..... 440/1, 440/84, 85; 340/539.21; 180/272
See application file for complete search history.

(56) References Cited

U.S. PATENT DOCUMENTS

| | | | | |
|---|---|---|---|---|
| 4,305,143 A | | 12/1981 | Simms | 367/134 |
| 4,714,914 A | | 12/1987 | Boe | 340/573 |
| 5,021,765 A | | 6/1991 | Morgan | 340/539 |
| 5,171,171 A | * | 12/1992 | Tani | 440/1 |
| 5,349,329 A | | 9/1994 | Smith | 340/539 |
| 5,593,330 A | * | 1/1997 | Kobayashi | 440/84 |
| 5,838,227 A | | 11/1998 | Murray | 340/425.5 |
| 5,945,912 A | | 8/1999 | Guldbrand | 340/573.1 |
| 6,157,303 A | | 12/2000 | Bodie et al. | 340/573.6 |
| 6,352,045 B1 | | 3/2002 | Takashima | 114/55.5 |
| 7,083,482 B2 | * | 8/2006 | Bouge et al. | 440/1 |

* cited by examiner

*Primary Examiner*—Lars A. Olson
(74) *Attorney, Agent, or Firm*—C. Nessler

(57) ABSTRACT

A safety system, which stops the motion of a boat or other craft when a person falls off the craft, is comprised of a wireless transmitter carried by the person, a receiver-controller, an actuator, and a spring loaded kill switch (ignition switch). When the person falls off and moves away, the diminution in wireless signal causes the actuator to remove a latch key or clip from the spring-loaded kill switch, thus stopping the engine. The actuator stores manually input energy, to enable the use of a compact and low power solenoid type coil. The system is suited for retrofitting onto boats having lanyard type kill switches.

17 Claims, 8 Drawing Sheets

SAFETY SHUT-OFF SYSTEM FOR A POWERED VEHICLE

TECHNICAL FIELD

The present invention relates to devices for stopping operation of the power source of a vehicle, in particular the engine of a water craft, when the operator or other person falls off.

BACKGROUND

An obvious problem is how to protect the operator of a small boat or so-called personal water craft, when the person is alone, if the person falls overboard into the water while the boat engine is propelling the boat. The boat can continue to run on its course, leaving the operator alone in the water and in jeopardy, especially when the boat is distant from land or other boats.

A common means for protecting the operator in the prior art is as follows. A tether or lanyard runs from the operator's belt or other attachment to a plastic mechanical clip, familiarly called a "key", which slips onto the outside of a kill switch of the boat engine. The kill switch is typically located on the control or instrument panel of the boat. It has a movable spring-loaded part which has to be held in a certain position for the boat to run. As shown in FIG. 1, such key 40 which works with the spring loaded portion of the switch is distinguished from a metal turn key 34 which turns within the switch. Hereinafter, such key 40 is referred to as a latch key. When the operator falls overboard the lanyard tensions and pulls the latch key for the switch. The spring action within the kill switch breaks the electric circuit of the engine ignition system, turning off, or "killing" the engine. Taskahsima U.S. Pat. No. 6,352,045 describes a kill switch and engine control system of such type. The presumption is that the operator can swim back to stopped boat.

The disadvantage of such prevalent type of commercial system is that use of a lanyard, although simple, inhibits the normal movement of the operator and such other persons as may be on the watercraft. The kill switch can be inadvertently tripped by the operator when he or she moves about normally, or when the operator strays too far from the switch location but has not fallen overboard. Many boat operators and occupants regard the device as a nuisance and something that "gets in the way". As a result, oftentimes the operator does not fasten the lanyard to his or her person, thus defeating the goal of providing safety. It is not uncommon to view boats in operation, with the lanyard dangling down the instrument panel from the switch, and running to nothing. Also, the present system can't protect against a person other than the operator from falling overboard.

Other inventors have attacked the problem of providing protection in a less inconvenient way. For example, Simms U.S. Pat. No. 4,305,143 describes the essential problem of "man-overboard". See also the Murray patent, mentioned below. Simms describes an ultrasound device which is activated by a hydrostatic switch, which in turn is activated by contact with the water with which the boat operator contacts upon falling overboard. The ultrasound unit that responds to the signal is contained within the control circuit of the engine, separate from the kill switch. Boe U.S. Pat. No. 4,714,914 describes how immersion in water triggers a radio signal from a device worn by the operator. The signal causes various optional things to happen, including causing a solenoid valve to shut off the fuel to engine. Morgan U.S. Pat. No. 5,021,765 describes a unit comprised of a dual receiver radio signal system. Activation when the operator falls overboard causes an alarm to sound at the boat, or causes ejection of a life buoy into the water. Guldbrand U.S. Pat. No. 5,945,912 describes a system having a transmitter carried by the operator, which transmitter floats. When the operator falls overboard, the transmitter signals a receiver on the boat. That causes actions on the boat, including optionally the activation of a kill switch or lowering of the sails. Murray U.S. Pat. No. 5,838,227 describes a radio receiver that has been wired into the engine control circuit. When a signal to the receiver from a radio transmitter carried by the operator falls below a threshold level, the receiver causes the engine to stop or takes other pre-programmed action.

While lanyard-free systems of the type mentioned above may serve the intended purpose, they have not found wide commercial use. From inquiry and observation, the reasons appear to include: that the prior art devices lack essential simplicity and low cost of the lanyard system; that they have to be either installed at the factory, or inconveniently in the field by a skilled electrician; and, that it is difficult to adapt hard-wired systems to the diversity of boat instrument panel and wiring configurations. Thus, there is a continuing need for improvement in addressing the problem.

Analogous problems are presented by land vehicles, such as motorcycles, particularly those used in racing, and by snowmobiles, where is it bad for the vehicle to keep running when the operator falls off.

SUMMARY

An object of the invention is to provide an improved way of killing the engine of a watercraft, when the operator or another occupant falls overboard or otherwise moves away. A further object is to provide a means for replacing the lanyard with a wireless device, which can be retrofitted onto a watercraft having a familiar lanyard-actuated kill switch, without need for intervention into the craft wiring system. A further object is to provide a wireless man-overboard system which is simple and economic to construct and install.

In accord with the invention, the engine of a water craft is stopped when a person falls off the craft by means of an actuator, which acts in response to pre-determined diminution of a wireless signal from a transmitter carried by the person, to remove the latch key from a kill switch configured along the lines of kill switches used in the prior art with lanyards.

In further accord with the invention, an actuator is fastened to the latch key to thereby form a hold-release assembly which is engaged with the switch body. The actuator has a movable element, e.g., a rod, for pushing against the kill switch body, to push the assembly from the body and thus withdraw the latch key from the kill switch, thereby shutting off the craft engine. In another embodiment, the actuator pulls on a tether connected to a fixed point, to pull the latch key and actuator assembly from the kill switch. In another embodiment, an actuator is fixedly mounted near the switch and is connected to the latch key by a tether, to thereby form the hold-release assembly; and the actuator has a movable element which pulls on the tether.

In a preferred embodiment, a portable transmitter is carried by the operator or other person on the water craft and continuously sends a wireless signal to a receiver mounted on the watercraft. The latch key of a hold-release assembly holds a spring actuated plunger of the kill switch in a position which enables the engine to run. When the wireless signal diminishes below a predetermined threshold, as when the person falls overboard and separates, the receiver signals a controller that activates an electric coil of an actuator. The coil moves internal parts of the actuator, and spring loaded components which move a push or pull rod or other movable element, which results in sliding removal of the latch key from the kill switch. The engine and motion of the craft is stopped, presumably enabling the overboard person to swim back to the craft.

Further, in the preferred embodiment, after a use in which the engine is stopped, the actuator is reset for another use by manually pushing on the actuator rod, to re-store mechanical energy in the actuator, and the latch key is re-engaged with the switch. The use of the manually input energy provides the substantial force needed to remove the latch from the switch, and lessens the amount of electric power which is required, along with enabling a small actuator. In other embodiments, the actuator may use only electric energy, like a common solenoid, or may use compressed gas. The transmitter has self-contained battery power supply and the receiver, controller and actuator may be powered from batteries or the water craft electrical system. More than one transmitter carried by more than one person may be used in the invention.

The invention permits an operator or other person to move about freely within the confines of a boat, compared to a system which uses a lanyard running to the person from the switch. The invention permits the installation of a wireless signaling system on an engine powered craft which has pre-existing lanyard type kill switch, without need of a skilled tradesman or intervention into the electrical system of the craft. The invention is also useful with land craft and with a sail powered boat. In the latter case, the actuator releases the sheet which secures a sail when there is a change in wireless signal.

The foregoing and other objects, features and advantages of the present invention will become more apparent from the following description of preferred embodiments and accompanying drawings.

DESCRIPTION

The invention is described in terms of a boat, but will be understood to be useful to other water craft, for instance so-called personal water craft or jet-skis, for which it is appropriate to stop motion when an operator or other person falls overboard. In comprehensive form, the invention system is comprised of several essential components, the relationship of which is shown in block form in FIG. 1. Transmitter 26, having a self-contained battery power supply is carried by the operator or other person on a boat. It is in wireless radio communication with a receiver-controller 24, that has its own power supply 28, which may be that of the boat. The receiver-controller is in electromagnetic communication with the hold-release assembly (HRA) 60, as by wires or radio or light waves. The HRA 60 is physically connected to the boat kill switch, which has a built-in spring loaded "kill" mechanism. Such type of kill switch is well known commercially, for use with internal combustion engines on boats. See Taskahsima U.S. Pat. No. 6,352,045, the disclosure of which is hereby incorporated by reference. The type of kill switch used with the invention has a movable part which must be continuously held against a spring bias in order to sustain current flow in the engine ignition circuit and to keep the engine running. The kill switch 30 used in describing the best mode of the invention here has a central plunger which must be pushed down. The primarily mechanical aspects of the invention are first described. Then the functioning of the control circuit is described.

Figure 2:
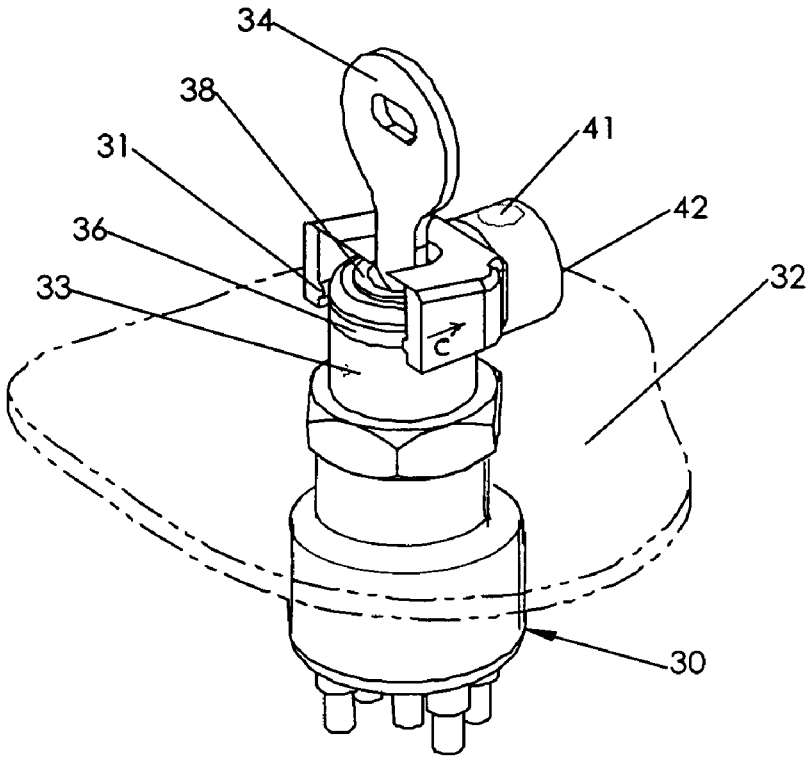
FIG. 2 is an isometric view showing a kill switch having a turn-key and an attached latch key and a portion of instrument panel in phantom.

FIG. 2 is an isometric view of a common kill switch 30 is shown as it mounts in a boat instrument panel 32, shown in phantom. A latch key 40 (also called a clip or simply a key), preferably made of thermoplastic, is engaged with switch 30 in the same manner as is familiar for lanyard-type latch keys used in the prior art. The means for connection of a lanyard to the kill switch is suggested in FIG. 2 by phantom hole 41. A feature of the invention is that it is suitable for retrofit to water craft having a variety of prior art kill switches. A further feature of the invention is a boat operator can use it in conjunction with an old-style lanyard running to his or her person, so either the lanyard or actuator causes the kill switch to stop the engine.

The internal combustion engine ignition system of a boat having kill switch 30 is turned on and off by rotation of common serrated key 34 inserted into switch 30. By design of the switch, to enable the engine to run it is also necessary that the plunger 38, the center part of the switch, be continuously depressed. To enable that, a boat operator slides latch key 40 into place around the switch, as it is shown in FIG. 2. The latch key has opposing side lips 31 within its interior cavity, which the operator engages with groove 36 of the switch body 33. In doing this, the operator necessarily depresses plunger 38; and, when in place, the top of the latch key keeps it from springing upwardly. When, afterwards, sufficient lateral force and energy is applied to the latch key, as indicated by arrow C in FIG. 2, plunger 38 springs upwardly, shutting off the boat engine. In the invention, that lateral force is provided by the actuator 50.

The upward spring force of the plunger 38 on the latch key causes friction force at the groove. By design, friction force is also created by outward expansion of the opposing sides of the latch key, in the circumferential plane of the groove. The combined frictional forces are intended to keep the latch key in place under light lateral forces, which is especially important in the lanyard type prior art system. In an embodiment of the present invention, the latch key and actuator form an assembly 60 which is supported off the switch, thus also necessitating good frictional engagement. The frictional forces are sufficient to keep the latch key engaged with the switch body in the presence of normal shaking and bumping of a boat. It may take from 5 to 8 pounds of lateral force to pull the latch key away from the switch. But as may be appreciated, that means the actuator needs to apply commensurate force to disengage the latch key. Brute force, in terms of an electric solenoid actuator may be employed, but at the penalty of weight and high electric power demand. Preferably, as described in detail below, energy is stored in the actuator by manual compression of a spring. When a person falls overboard, energizing of a small electric coil in the actuator releases the spring energy, thus providing the sufficient energy and force to pull the latch off the switch.

Figure 3:
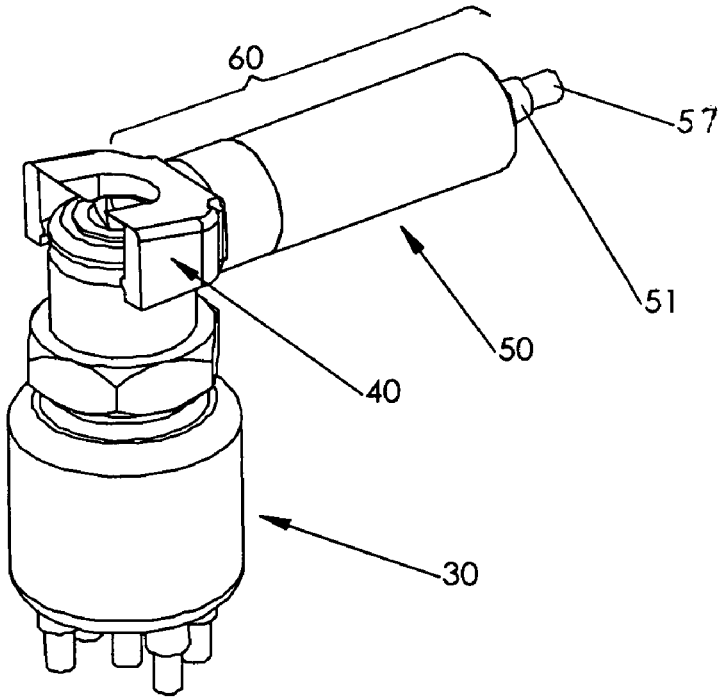
FIG. 3 is a different isometric view of the kill switch of FIG. 2, on which is mounted hold-release assembly (HRA) comprised of a latch key fastened to an actuator.
Figure 4:
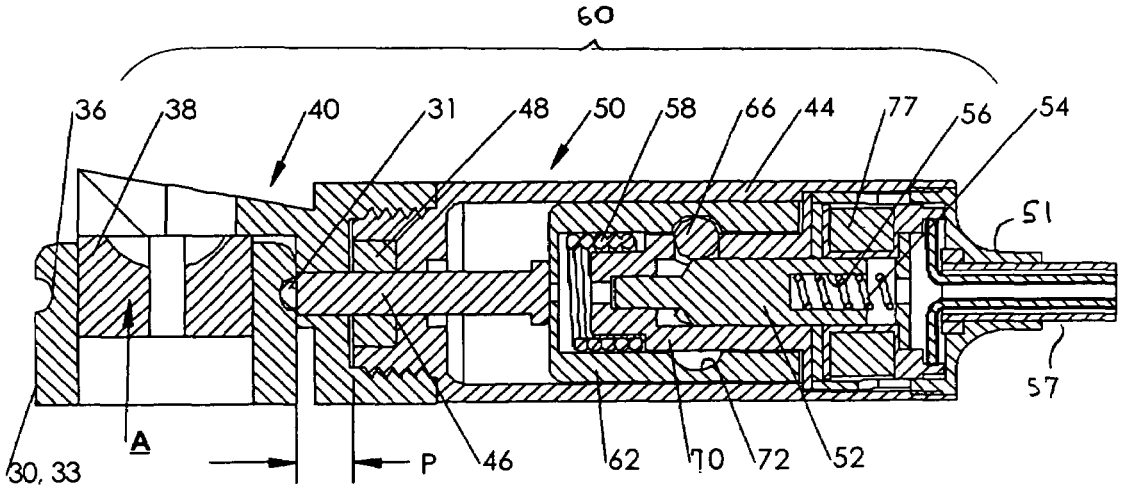
FIG. 4 is a longitudinal plane cross section of the hold-release assembly HRA of FIG. 3, and a portion of the kill switch, showing the actuator in un-energized condition.
Figure 5:
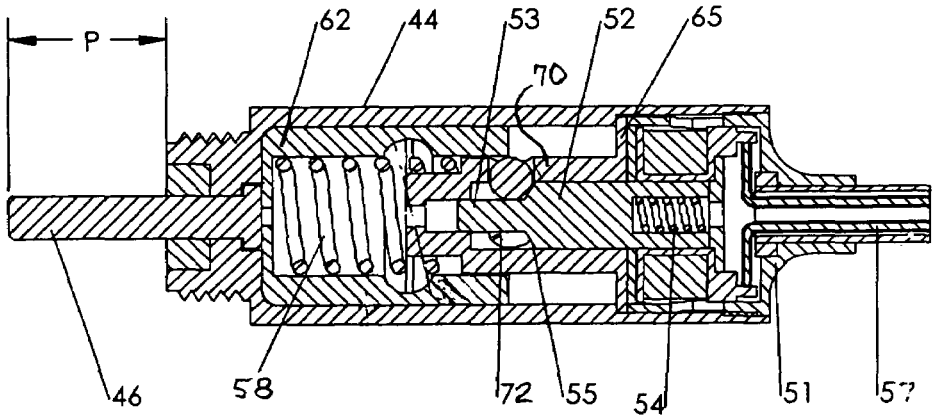
FIG. 5 is a view mostly like FIG. 4, showing the hold-release assembly HRA after the coil has been energized to extend the push rod and discharge the assembly from engagement with the switch. The view also shows and optional end cap which protects wires running to the coil.

In the embodiment of FIGS. 3–5, latch key 40 is fastened to actuator 50, preferably by threads as shown, to form an integral Hold-Release Assembly (HRA) 60. When the latch key is engaged with the switch, assembly 60 has holds the switch plunger depressed in place. When the signal received at the receiver at the boat diminishes below a pre-determined threshold, the latch key is pulled off the switch by actuator. A push rod of the actuator pushes against the side of the switch body, and the actuator is forced away from the switch, laterally pulling the attached latch key off the switch. If needed, the HRA can be attached to the instrument panel by a flexible cord to prevent it from falling away as it is disengaged from the switch. The latch key 40 can have different shapes from that illustrated here, as taught by the prior art. For example, some prior art kill switches have a plunger which must be held in raised position. The invention may also be applied to a kill switch which has a rotary, rather than up and down, "kill element" action; and to a kill switch which acts as does a toggle switch.

FIG. 4 is a longitudinal cross section of HRA assembly 60, showing in more detail how it engages kill switch 30. Latch key 40 is threaded onto outer housing 44 which is preferably made of thermoplastic. Other means of fastening, e.g., set screws, may be used. FIG. 4 shows the position of HRA components when sufficient radio signal from the transmitter is being received, i.e., when things are normal and the operator is in the boat. The actuator is said to be in its spring energized condition. In that condition, HRA 60 cantilevers in space from its mounting on the kill switch by means of the latch key engagement; and, plunger 38 is depressed. Arrow A shows the spring bias of the plunger and capability for vertical motion.

FIG. 5 is like FIG. 4 but shows the actuator 50 in its de-energized condition. This is the condition when the signal to the receiver has diminished or ceased, e.g., when someone has fallen overboard. The FIG. 4 view omits switch 30 and adds a desirable end cap 51, which screws onto the outside of housing 44 and protects wires, not shown, which run to the electromagnetic coil 77 at the right end of the actuator. Actuator 50 is connected by wires 57 or other electromagnetic power transmitting means to the receiver-controller.

Referring to both FIG. 4 and FIG. 5, a movable element, namely push rod 46, protrudes from a seal, preferably a lip seal 48, at the end of the actuator which attaches to the latch key. When HRA 60 is mounted on a switch, push rod 46 contacts or is in close proximity to the side of switch. See FIG. 4. When, as a consequence of diminution of radio signal strength received by the receiver-controller assembly 24, the coil 77 becomes energized, thus causing release of stored energy in main spring 58 which makes the push rod 46 move outwardly so that the plunger extension P increases. The extension P is sufficient to cause the latch key to withdraw from engagement with groove 36 of the switch. The whole HRA 60 moves to the right, and will fall away by momentum and gravity from vicinity of the switch. As desired, some restraint like a bracket or line may be used to keep it nearby. When the latch key is removed from the switch, switch plunger 38 moves upwardly, thereby cutting the engine ignition system.

To reinstall HRA 60 on the switch, push rod 46 is manually pressed inwardly to the position shown in FIG. 4. As described below, when that is done and HRA has been de-energized, the push rod stays pressed-in. The latch key lips 31 are slid back into the groove 36 of switch 30, while the switch center part 38 is manually depressed, as described above. The actuator provides sufficient force to pull the latch key from the switch, of the order of 5 to 8 pounds force. The actuator has unique construction to provide sufficient energy and force, but at the same time be compact and light, and economic to manufacture. This construction will now be described. Reference is again made to FIGS. 4 and 5.

In the FIG. 4 there is no power to electromagnetic coil 77 and the HRA is mounted on the kill switch. Shuttle 52 lies within the coil 77. It is made of electroplated magnetic steel. Shuttle spring 54 is of the compressive type. It is positioned within cavity 56 at the right end of shuttle 52. Coaxial sleeves 62, 70 circumscribe the shuttle 52. Fixed inner sleeve 70 has three circumferentially-spaced apart radial holes 71, within which are loosely held three latch key balls 66. Shuttle 52 moves lengthwise within the bore of inner sleeve 70. Inner sleeve 70 moves lengthwise within the bore of outer sleeve 62. In use, balls 66 alternately move radially out and in, as described below, to thereby alternately lock and release the sleeves 62, 70 from engagement with each other.

Inner sleeve 70 is made of non-magnetic material, such as Delrin thermoplastic or stainless steel. It is fixed in position by engagement of flange 65 with the bore of Nylon housing 44. Outer sleeve 62 is made of 300 series stainless steel. When outer sleeve 62 moves lengthwise (to the left in the FIG. 4), the closed end of sleeve 62 pushes on stainless steel push rod 46, increasing its extension from the actuator housing. Conversely, when push rod 46 is pressed inwardly, it moves sleeve 62 to the right toward its home position where it stays, provided the actuator and coil are de-energized. Manually pushing the push rod in compresses main spring 58, which is captured between the outer and inner sleeves so it urges them to separate. The drawings show various axial holes along the central axis which allow escape or entry of air, so captured air or vacuum does not impede the linear motions of the parts.

In operation of the actuator, coil 77 is energized as a result of a change in radio signal from the transmitter worn by a person who has fallen overboard or who has otherwise left vicinity of the receiver controller. When the coil is energized, shuttle 52 is magnetically moved into the coil 77 (to the right in the FIG. 4), thus compressing shuttle spring 54 and storing energy therein. The left end of shuttle 52 has a tapered shoulder 55 running to a smaller diameter end 53. The spring force on sleeve 62 is applied to the balls 66, urging them radially inwardly. Thus, when the smaller diameter portion of shuttle 52 moves and presents itself at the transverse plane location of the balls, they do move inwardly. That frees outer sleeve 62 from engagement with inner sleeve 70. That enables outer sleeve 62 to move away from the coil (to the left in FIG. 4). The motion of sleeve 70 causes push rod 46 to extend, and thus HRA 60 is ejected from the kill switch. The disposition of the internal parts of the actuator after these actions have taken place is shown in FIG. 5.

After the push rod has extended, electric power to the coil will be terminated by a control circuit timer in the controller. However, when the power to the coil is terminated, shuttle 52 does not move back to its home position, since it is restrained by balls 66 which are in contact with its shoulder 55. Nonetheless, the operator of the boat will now reset the actuator for another use. The operator manually depresses push rod 46. That compresses main spring 58 while moving outer sleeve 62 to the right, toward the coil. When the motion of sleeve 62 is sufficient, balls 66 will be thrust outwardly due to the force of shuttle spring 54, transmitted at shoulder 55 of the shuttle 52. Then, shuttle 52 moves in the opposite direction, with release of the stored energy in shuttle spring 54. The changed position of the shuttle prevents radially inward motion of the balls, and the outer sleeve 62 is again locked into its home position, characteristic of the de-energized state of the device. In a variation not shown, the push rod may rotate a cam which is in contact with the side of the switch body, for more amplification of mechanical force. Within the scope of the claimed invention, the term spring as used herein is intended to comprehend devices other than those made of spring-steel for storing energy, such as elastomers, gas compression cylinders (gas struts), and spring substitutes, such as linear actuators.

In the generality of the actuator construction and use, manual or mechanical energy of the operator is stored in the device, e.g., in the main spring by depressing the push rod to set the device. Release of that stored mechanical energy is prevented by an internal mechanical latch keying means, e.g., the balls. Electromechanical means, e.g., the coil and movement of the shuttle when the coil is energized (which movement is often referred to as "solenoid action"), releases the actuator internal locking mechanism, to enable release of the stored energy, which extends the push rod and ejects the HRA from the kill switch.

In some commercial kill switches, the movable element is spring biased to cause the plunger to move inwardly, into the switch body, rather than outwardly, when the latch is removed, to stop an engine. The invention will be useful with such devices by use of a suitable latch, similar to that used when such devices are operated by means of a lanyard.

Figure 6:
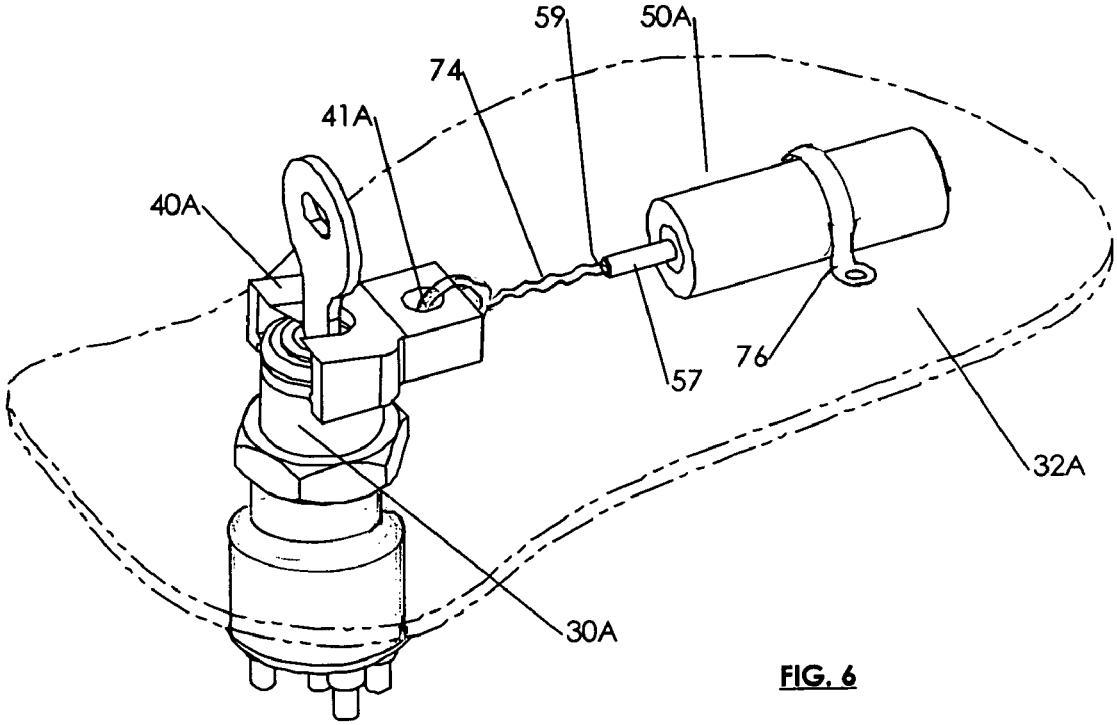
FIG. 6 is an isometric view of a hold-release assembly HRA wherein the spaced apart actuator is connected to the latch key by a tether.
Figure 7:
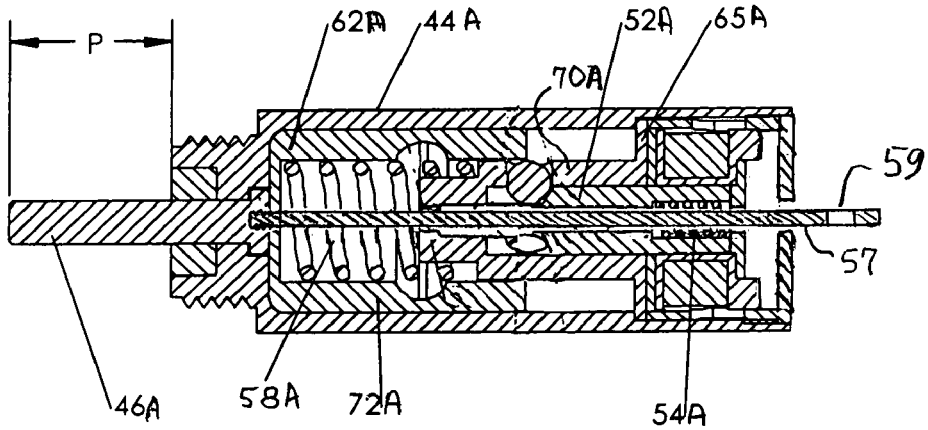
FIG. 7 shows an actuator having a push rod rather than a pull rod.

FIGS. 6 and 7 show an alternate embodiment of the invention in which the rod of the actuator pulls rather than pushes. Parts having numbers with suffixes in these and other Figures correspond with those previously described. The latch key 40A is mounted on the switch 30A as previously described. Actuator 50A is fastened by clamp 76 to the instrument panel or another surface of the boat in vicinity of the kill switch. Tether 74 runs between the pull rod 57 of actuator 50A and latch key 40A. When commanded to act, the actuator pulls on the tether, pulling the latch from the kill switch, to stop the engine FIG. 7 shows one way in which the actuator 50 of FIGS. 4 and 5 can be modified to pull rather than push. FIG. 7 is an adaptation of FIG. 5, and shows the actuator when rod 57 has been pulled into the actuator. The power lines running to the coil are omitted. Pull rod 57 screws into the base of shuttle plunger 46A; and it extends through clearance bores in the various components including elements 70A and 52A. Hole 59 enables connection of tether 74 to rod 57. For this and other embodiments, variations in the mechanical construction of the actuator may be employed to achieve the same functional result. Commercially available solenoid type actuators may be utilized, although that could involve more complexity or larger size.

Figure 8:
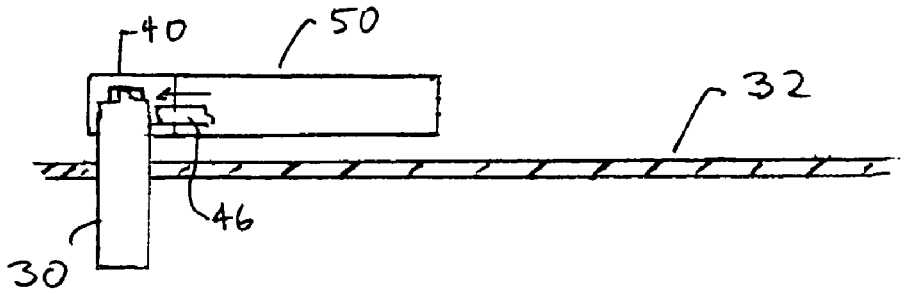
FIG. 8 is a semi-schematic view of essential parts of the invention system, showing a latch key fastened to the actuator, where the assembly is mounted on the switch, in accord with FIG. 3.
Figure 9:
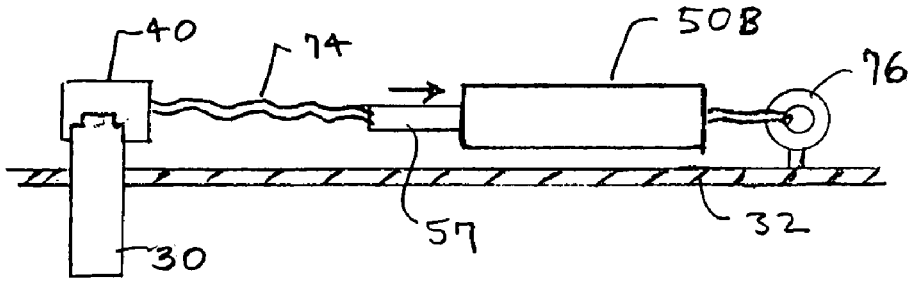
FIG. 9 is similar to FIG. 8, showing an actuator which is tether connected both to the craft and to the latch key which is on the kill switch.
Figure 10:
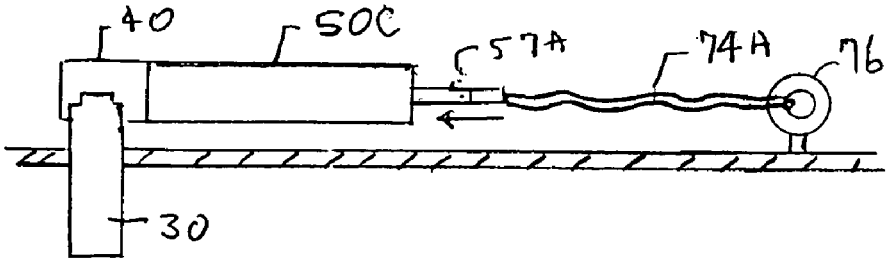
FIG. 10 is similar to FIG. 8, showing a latch key fastened to the actuator which is tether connected to the craft.

FIGS. 8, 9 and 10 semi-schematically show different embodiments of the invention. The motion of the rod of the actuator is indicated by an arrow. FIG. 8 corresponds with the invention described for FIGS. 3, 4 and 5. FIG. 9 corresponds with FIGS. 6 and 7, with the variation that an end of the actuator is connected to a second tether which runs from a ring attachment point 76, rather than having the actuator mounted on the instrument panel 32. FIG. 10 shows another variation, in which the actuator has a rod 57A which, when energized, retracts and pulls on tether 74A that runs to ring 76. The resultant tension force causes the latch key and actuator assembly (40 and 50C) to be pulled from the kill switch.

While an actuator having a rod which moves linearly has been described, other forms of actuators can be used, as are known in the ordinary skill, for obtaining linear motion. For example, the movable element of the actuator can be a reel which draws a tether around it, in winch-like fashion. In another example, the movable element may be a rotatable cam, which pushes the actuator and HRA from engagement with the kill switch.

Figure 1:
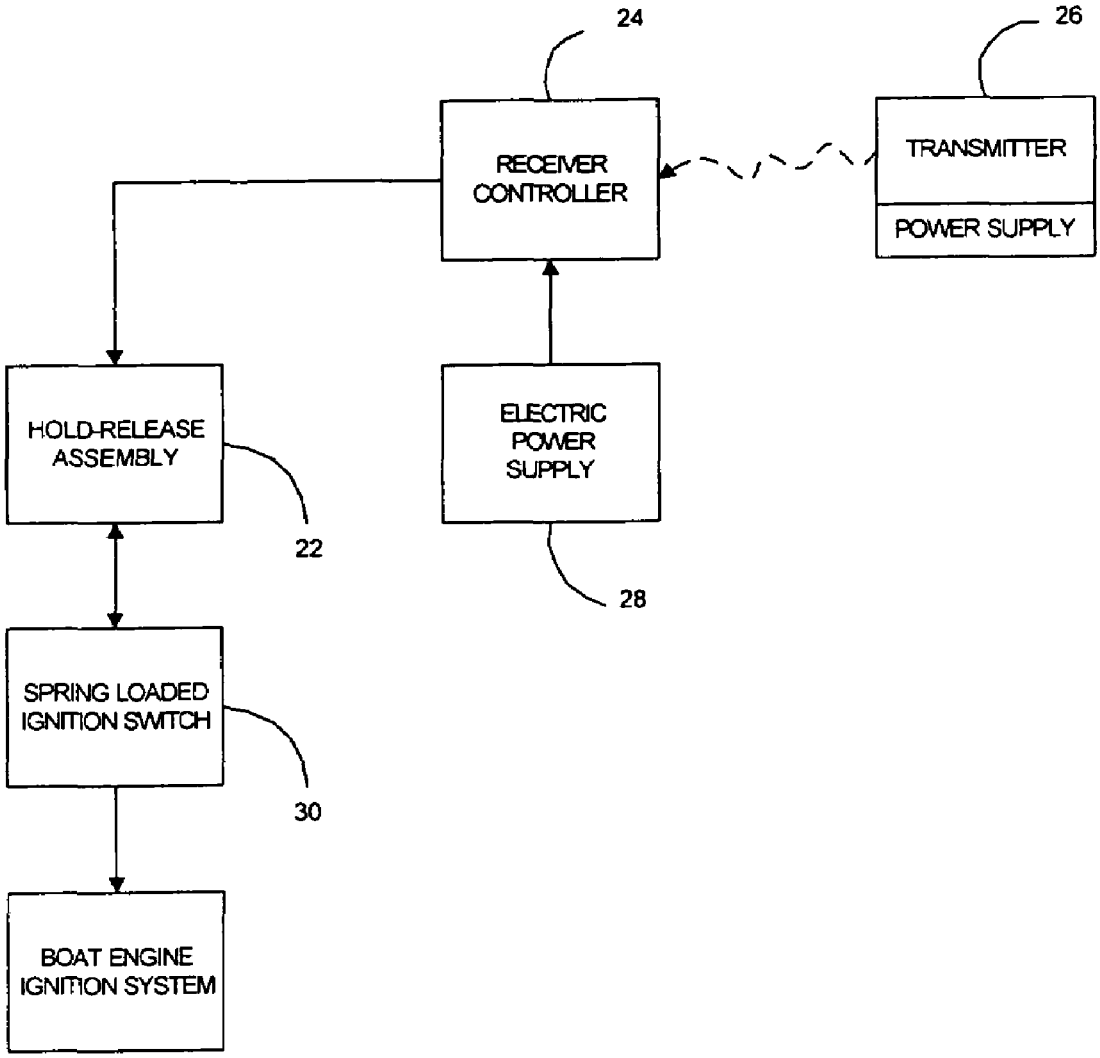
FIG. 1 is a diagram showing the major components an embodiment of the invention system.
Figure 11:
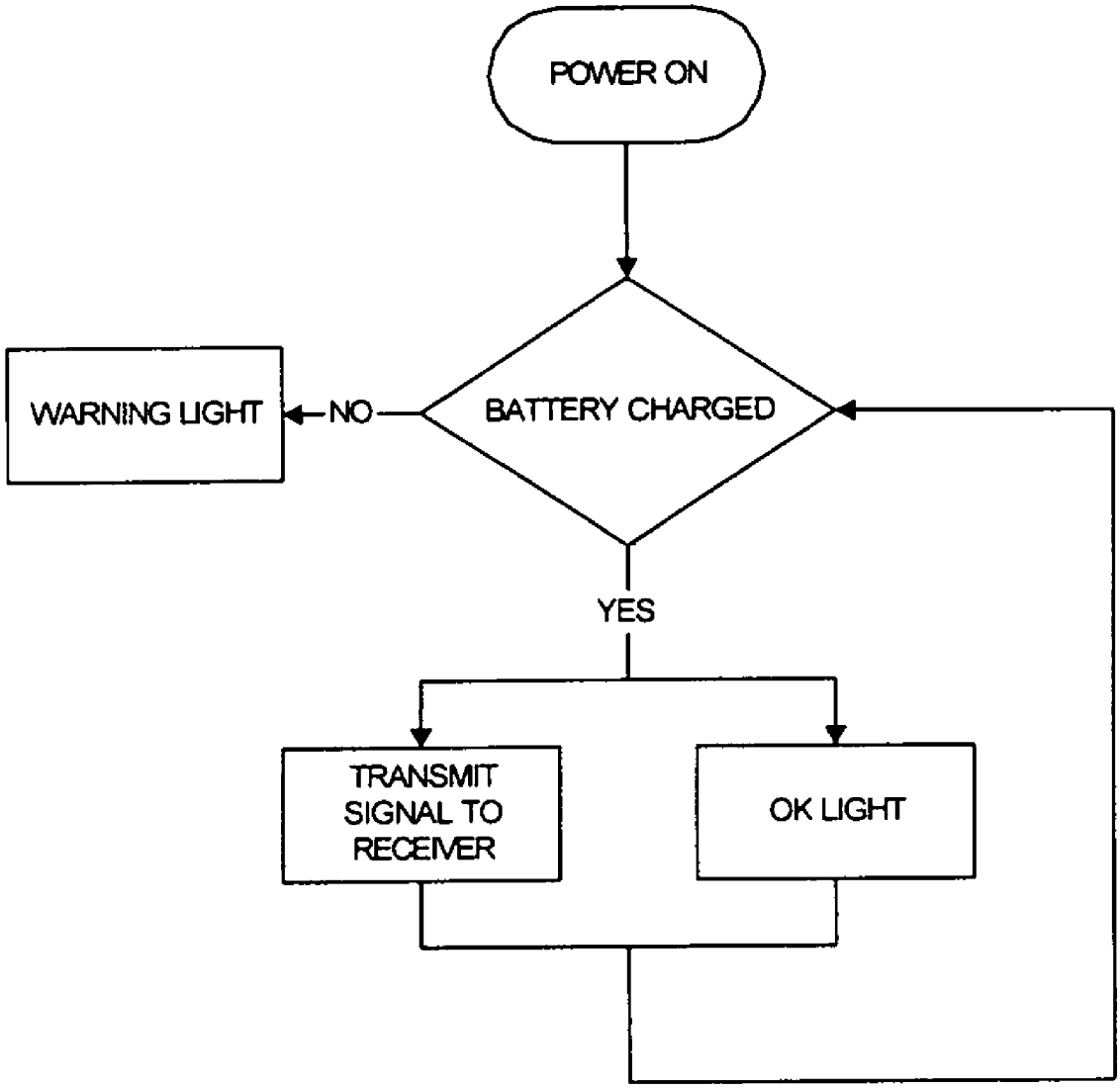
FIG. 11 is a function flow diagram for the receiver-controller and actuator which receives a signal from the transmitter
Figure 12:
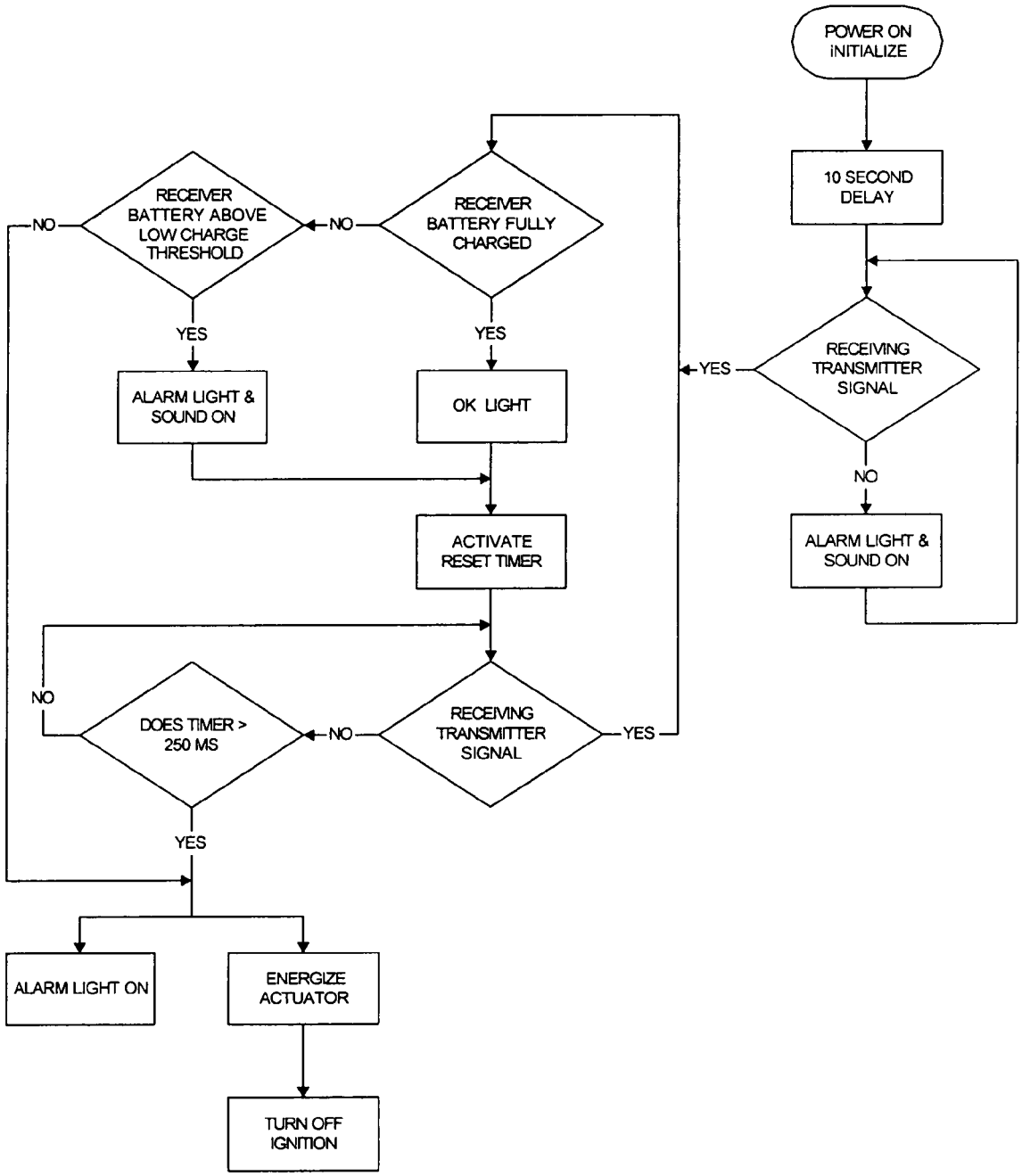
FIG. 12 is a function flow diagram for a transmitter which sends a signal to the receiver.

As mentioned, FIG. 1 shows the overall interconnectedness of the elements of the system of the present invention. FIG. 12 is a function flow chart for the receiver-controller 24 and FIG. 11 is a chart for the transmitter. They are discussed below. The radio transmitter 24, worn by the operator or other boat occupant, and radio receiver-controller 26, mounted on the boat, are preferably comprised of commercially available elements. For example, the transmitter may send signals at 300–400 megahertz. They may be constructed along the lines indicated in patents of the Background.

Generally, the controller commands the actuator to pull the latch key from the switch when the signal from the transmitter received by the receiver diminishes beneath a certain pre-determined threshold. That diminution in signal can be due to increased physical separation of the operator from the receiver, or due to immersion in water of the transmitter. The threshold can be fixed, or settable according to the dimensions of the boat or other user-factors. In alternate embodiments, other electromagnetic signaling than those which use radio frequency wavelength may be employed. For instance, ultrasonic or optical sources and sensors may be used.

FIG. 12 shows the functioning of receiver-controller 24, hereafter simply called "receiver." The receiver has conventional components for converting input radio signals to output to the actuator. The unit and any self-contained battery power supply are preferably within a water-tight box, upon the surface of which are mounted switches, visual alarms and other displays which may be desired.

In a first part of its function, the receiver checks to see if a signal from the transmitter is present. If it is not, an alarm is given and the device will not function. If the transmitter signal is present, the system checks the condition of the receiver power supply, i.e., the battery charge or voltage. If it is wholly inadequate, an alarm is given, and the actuator is commanded to pull the latch key from the switch. If the power supply condition is marginal, an alarm is given, but the unit will function. The system persistently checks to see if the requisite transmitter signal is present. If a sufficient signal is not received, there is appropriate re-checking, with use of a timing circuit, to accommodate a momentary inconsequential lapse of signal, or other electrical fluctuation. When a continuing absence of sufficient signal is verified, the receiver causes the actuator coil to be energized by applying power to it. The actuator thus mechanically removes the latch key from the switch, as previously described. The engine ignition system is thus killed. Power flow to the coil and or the receiver may then be terminated by functions which are not shown in the chart. To reset and reinstall the mechanism on the kill switch, the power flow to the coil is ceased, as necessary. The operator mechanically resets the HRA by pushing on its push rod, as described above, and remounts the latch key on the switch. Then the power to the receiver is restored and the unit is ready to function again.

FIG. 11 shows the function of the transmitter 26. If the power supply is insufficient, a warning light is displayed. If power is sufficient, an OK light is displayed and a radio signal is continuously and omni-directionally transmitted.

The technology for sending signals from portable transmitters to a receiver, and detecting and acting on them, is well known in the electric control system arts. We have only described a simple radio transmit-receive system. More sophisticated techniques known in the art may be employed, particularly for reliability or for difficult operating environments.

And other electromagnetic means of sensing the presence or absence of proximity of a person or thing to the controller and craft may be used. While an active continuously-transmitting device is preferably carried by the operator, non-continuously signaling and interrogation type systems may be used. For instance, RFID and ultrasound technology may be used. Radio signals typically diminish when the transmitter becomes submerged, thus enabling quick signaling to the receiver to stop the engine. Radio signals are preferred in practice of the invention, but other wireless communication means, such as optical devices may be substituted. In an alternate less preferable approach, a device which sends a signal when coming into contact with water may be used, when in the normal condition, there is no signal being transmitted.

The system has been described in terms of a single transmitter. Multiple transmitters on multiple people may be used; and, the receiver can be configured to receive their different frequency signals, and to act on a failure to receive any one signal.

Other actuators may be employed in place of the electromechanical HRA which has been described, to withdraw the latch key from the switch. For instance, the actuator may be miniature pneumatic piston cylinder with an associated gas supply such as a compressed carbon dioxide miniature tank. When the requisite transmitter signal is not received, the receiver-controller activates a valve, causing flow of compressed gas into the cylinder, to move a push rod or pull rod, and remove the latch key, in the way described. Such a system is less preferred because of the possibility of gradual gas leakage over an extended period of time.

The invention can be applied to kill switch designs other than that illustrated, by modification within the ordinary skill of artisans. For example, some kill switches comprise a central button which retracts into the body of the switch, when the latch key is withdrawn from the grooves of the button. For example, some switches have a tang which is engaged by a plastic loop; and when the loop is pulled away from the switch, the engine is killed. For instance, a non-magnetic shaft attached to the closed end of outer sleeve 62 could run through a lengthwise hole in shuttle 52, so it extends from the rear end of housing 44. While the actuator is preferably intimately physically attached to the latch key as has been described, in alternate embodiments the actuator may be spaced apart from the latch key and switch, to be connected by a lanyard.

While the invention enables continued manufacture and use of boats with the familiar lanyard type kill switches, the invention may carried out with new kill switches, especially configured for use with a wirelessly commanded actuator. Similarly, the invention may be applied to craft having diesel engines which do not require used of an ignition system, by actuating the means by which the engine is ordinarily stopped, such as by stopping fuel flow to the engine through an electrically controlled valve.

While the invention has been described in terms of water craft, it may be applied in similar fashion to land craft. For instance, it may be used with motorcycles, snowmobiles and the like, which are powered by internal combustion engines.

The invention offers advantages previously sought by other inventors, where separation of a transmitter and receiver causes the killing of the engine. Moreover, the invention enables a boat which is in the field, or in a factory, to be fitted with a non-lanyard safety system without intervention into the electric system or use of any electrical craft skills.

Figure 13:
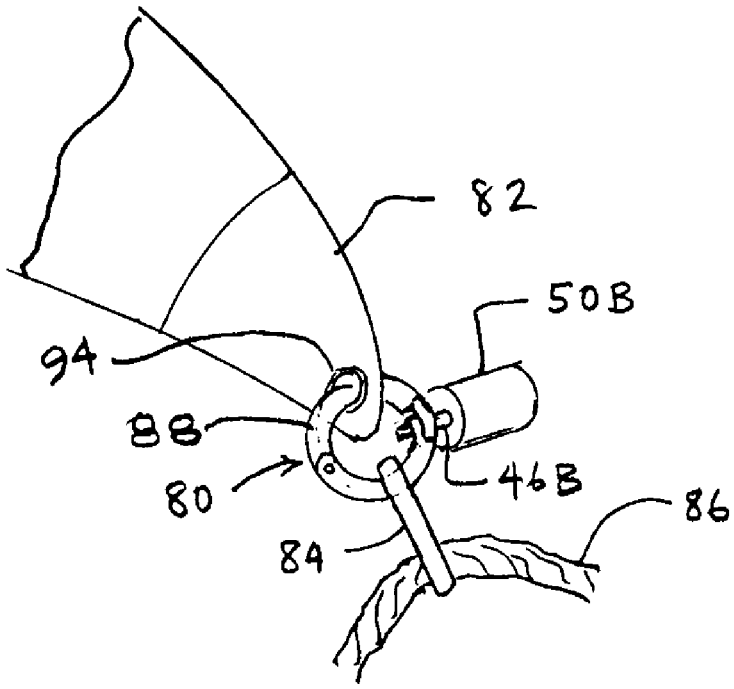
FIG. 13 shows how the invention can be used to release the sheet of a sail of a sailboat.
Figure 14:
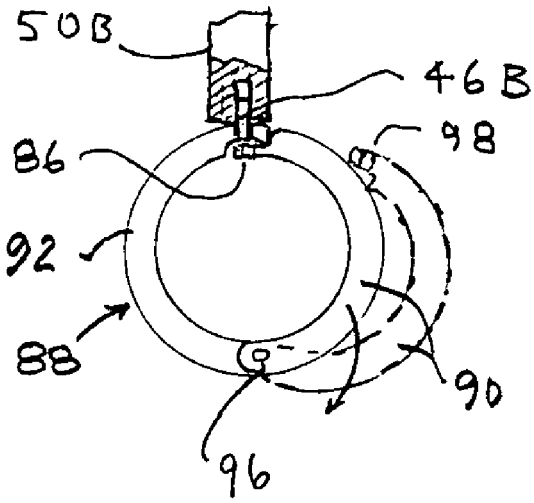
FIG. 14 is a detail of the split ring used in the apparatus of FIG. 14.

In another embodiment, the invention may be applied with good effect to water craft for which the sail is the power source. In the embodiment illustrated by FIGS. 13 and 14, a sheet (rope) 86 normally holds the sail in the position where it powers and propels the boat through the water. In carrying out the invention, the sail is connected to the sheet by hold release assembly (HRA) 80. Assembly 80 is comprised of a split ring 88 and actuator 50B. The two hinged semi-circular halves 90, 92 of the split ring are connected by hinge pin 96 and opposing side ship-lapped ends. The ship-lapped ends have aligned holes 98 through which pull rod 57B of actuator 50B passes. The actuator is fixed to ring half 92 by structure which is not shown, within the ordinary skill.

When installed for use, sail sheet 86 runs through one-piece ring 84 which is attached to the sail by means of split ring 88. Actuator 50B is constructed similarly to actuator 50A of FIGS. 6 and 7. When, as a result of the change in transmitter to receiver signal, rod 57A is pulled from the holes of the ship-lapped ends of the split ring, the force between the sail and sheet pulls the split ring apart, as illustrated by the phantom of ring half 90 in FIG. 14, thus releasing the sail.

Although this invention has been shown and described with respect to one or more preferred embodiments, and by examples, those should not be considered as limiting the claims, since it will be understood by those skilled in this art that various changes in form and detail thereof may be made without departing from the spirit and scope of the claimed invention.

We claim:

1. Apparatus for stopping an engine of a water craft when a person falls off the craft, wherein the craft has a spring actuated kill switch, comprising:

means for wirelessly sending a signal to a receiver on the craft, for carrying by a person on the craft;

a latch key, for engagement with the kill switch, to thereby hold a spring actuated part of the kill switch in a position where the engine runs; and, means for disengaging the latch key from the kill switch, responsive to a predetermined change in the strength of said wireless signal at the receiver.

2. The apparatus of claim 1 wherein said means for disengaging the latch key from the kill switch comprises:

an actuator directly fastened to the latch key, to thereby form a hold-release assembly, the actuator having a movable element for pushing the assembly off the kill switch.

3. The apparatus of claim 1 wherein said means for disengaging the latch key from engagement with the kill switch comprises:

an actuator connected to the latch key by a tether, to thereby form a hold-release assembly, the actuator having a movable element for pulling on the tether.

4. The apparatus of claim 1 wherein said means for disengaging the latch key from engagement with the kill switch comprises:

an actuator directly fastened to the latch key, to thereby form a hold-release assembly, the actuator having a movable element for pulling on a tether;

a tether, attached to said movable element of the actuator, for connecting the hold-release assembly to an object which is fixed relative to the kill switch;

wherein, when the actuator pulls on the tether, the hold-release assembly is pulled away from the kill switch.

5. The apparatus of claim 1, wherein, the means for wirelessly sending said signal is a portable transmitter; and wherein the means for disengaging comprises:

an actuator, connected to said latch key, to thereby form a hold-release assembly;

a receiver, carried on the water craft, for receiving said wireless signal from the transmitter and for sending a signal to a controller in response to a predetermined change in said wireless signal; and, a controller for causing an element of the actuator to move in response to a signal from the receiver;

wherein, movement of said actuator element disengages the latch key from engagement with the kill switch, to thereby stop the engine.

6. Apparatus for stopping an engine of a water craft when a person falls off the craft, wherein the craft has a kill switch having a body and a movable spring actuated plunger, comprising:

a hold-release assembly, comprising an actuator and a latch key; the actuator having a movable element; the latch key connected to the actuator and shaped for engaging the body of said kill switch and for holding said plunger in a position which enables said engine to run;

a transmitter, for carrying by said person and for wirelessly sending a signal to a receiver;

a receiver, carried on the water craft, for receiving said wireless signal from the transmitter and for sending a signal to a controller in response to a predetermined change in said wireless signal;

a controller for causing the movable element of the actuator to move in response to a signal from the receiver;

wherein, movement of said movable element disengages the latch key from said kill switch, to thereby release said plunger and stop the craft engine.

7. The apparatus of claim 6 wherein the actuator has spring means, for storing manually input energy which powers the movement of said movable element.

8. The apparatus of claim 6 wherein the latch key is fastened directly to the actuator.

9. The apparatus of claim 6 wherein said actuator movable element is a push rod which pushes against the kill switch body.

10. The apparatus of claim 6 wherein the hold-release assembly further comprises a tether, said tether connecting the latch key to the actuator.

11. The apparatus of claim 6 further comprising at least one second transmitter; wherein the first transmitter sends a first characteristic wireless signal to the receiver; wherein the at least one second transmitter sends a second characteristic wireless signal to the receiver; and, wherein the receiver sends a signal to the controller responsive to a predetermined change in either wireless signal.

12. The apparatus of claim 6 wherein the kill switch has a spring biased plunger in the center of the kill switch body; wherein, the latch key slidably engages groove portions on the exterior of the kill switch body and holds said plunger depressed within the switch body against the spring bias.

13. An apparatus for stopping a water craft engine when a person falls off the craft, of the type in which a change in electromagnetic signal from a transmitter carried by the person is sensed by a receiver on the craft, to thereby electrically stop operation of the craft engine, having the improvement which comprises:

a kill switch having a movable spring biased element, the element having a first spring-bias position at which the engine does not run and a second position at which the engine does run; and, a hold-release assembly, comprising an actuator and a latch key, the latch key shaped for engaging the kill switch and for holding the movable element of the kill switch in said second position when engaged with the switch; the actuator removing the latch key from engagement with the switch in response to a predetermined change in signal at the receiver, to thereby cause said movable switch element to move to the first position due to the spring bias.

14. The apparatus of claim 13 wherein the actuator stores manually input energy and wherein release of said energy removes the latch key from the kill switch.

15. A method of stopping the operation of a water craft when a person falls overboard, wherein the craft has a kill switch of the type which stops the engine when a latch key is removed from engagement with the switch, which comprises:

wirelessly sending a signal from a transmitter carried by the person to a receiver on the craft;

mechanically removing said latch key from engagement with the kill switch responsive to a predetermined change in the strength of said signal at the receiver.

16. The method of claim 15, wherein the latch key is removed from engagement by means of an actuator, which further comprises: mounting the actuator on the kill switch.

17. The method of claim 15, wherein the latch key is removed from engagement by means of an actuator, which further comprises: storing manually input energy in the actuator; and releasing said energy to thereby remove the latch key from the kill switch.

* * * * *